United States Patent [19]

Ishii

[11] Patent Number: 4,644,350

[45] Date of Patent: Feb. 17, 1987

[54] PAGER WITH AUTOMATICALLY ILLUMINATED DISPLAY

[75] Inventor: Daisuke Ishii, Tokyo, Japan

[73] Assignee: NEC Corporation, Tokyo, Japan

[21] Appl. No.: 654,082

[22] Filed: Sep. 25, 1984

[30] Foreign Application Priority Data

Sep. 26, 1983 [JP] Japan ..... 58-178683

[51] Int. Cl.[4] ..... G09G 3/18

[52] U.S. Cl. ..... 340/825.44; 340/311.1; 340/765; 116/263

[58] Field of Search ..... 250/205, 214 AL; 368/11, 67; 340/825.44, 761, 793, 792, 765, 311.1; 455/154, 159; 116/257, 263

[56] References Cited

U.S. PATENT DOCUMENTS

| | | | |
|---|---|---|---|
| 3,437,004 | 2/1976 | Natori et al. | 340/825.44 |
| 3,849,979 | 11/1974 | Tanji | 340/793 |
| 4,536,761 | 8/1985 | Tsunoda et al. | 340/825.44 |

FOREIGN PATENT DOCUMENTS

| | | | |
|---|---|---|---|
| 3210800 | 10/1983 | Fed. Rep. of Germany | 340/311.1 |
| 2434049 | 4/1980 | France | 340/793 |
| 56-56046 | 5/1981 | Japan | 455/159 |
| 60-105329 | 6/1985 | Japan | 455/159 |

*Primary Examiner*—Gerald L. Brigance

*Attorney, Agent, or Firm*—Sughrue, Mion, Zinn, Macpeak & Seas

[57] ABSTRACT

A pager comprising a light sensor which is responsive to light externally illuminating the pager to generate a first signal when the sensed light is below a predetermined luminance value. The first signal is supplied to a coincidence gate which provides a coincidence output when it detects the coincidence of the first signal with a second signal that is generated when there is a message on a display. The coincidence output feeds a light source to illuminate the display to make it visible under poor lighting conditions.

7 Claims, 4 Drawing Figures

PAGER WITH AUTOMATICALLY ILLUMINATED DISPLAY

BACKGROUND OF THE INVENTION

The present invention relates to pagers and in particular to a pager with an automatically illuminated message display.

Conventional display pagers include a manually operated mechanical switch to trigger a lamp to illuminate the display. However, it is desired to effect the illumination automatically according to ambient lighting condition.

SUMMARY OF THE INVENTION

It is therefore an object of the present invention to provide a pager having a display which is illuminated automatically when external luminance is lower than a predetermined value.

According to the invention, a pager includes a light sensor, such as phototransistor, which is sensitive to light externally illuminating the pager to generate a first signal when the sensed light is below the predetermined value. The first signal is supplied to a coincidence gate. A second signal to the coincidence gate is generated when there is a message on the display. Output from the coincidence gate is applied to a light source to illuminate the display to make it visible under poor lighting conditions.

The elimination of mechanical switch has brought about advantages in that the light sensor requires a smaller space than is required by mechanical switch, ensures an extended life time and waterproof construction.

The pager of the invention is further provided with a power saving feature that shuts off power supply to the light sensor in the absence of a message on display.

BRIEF DESCRIPTION OF THE DRAWINGS

The present invention will be described in further detail with reference to the accompanying drawings, in which.

DETAILED DESCRIPTION

Figure 1:
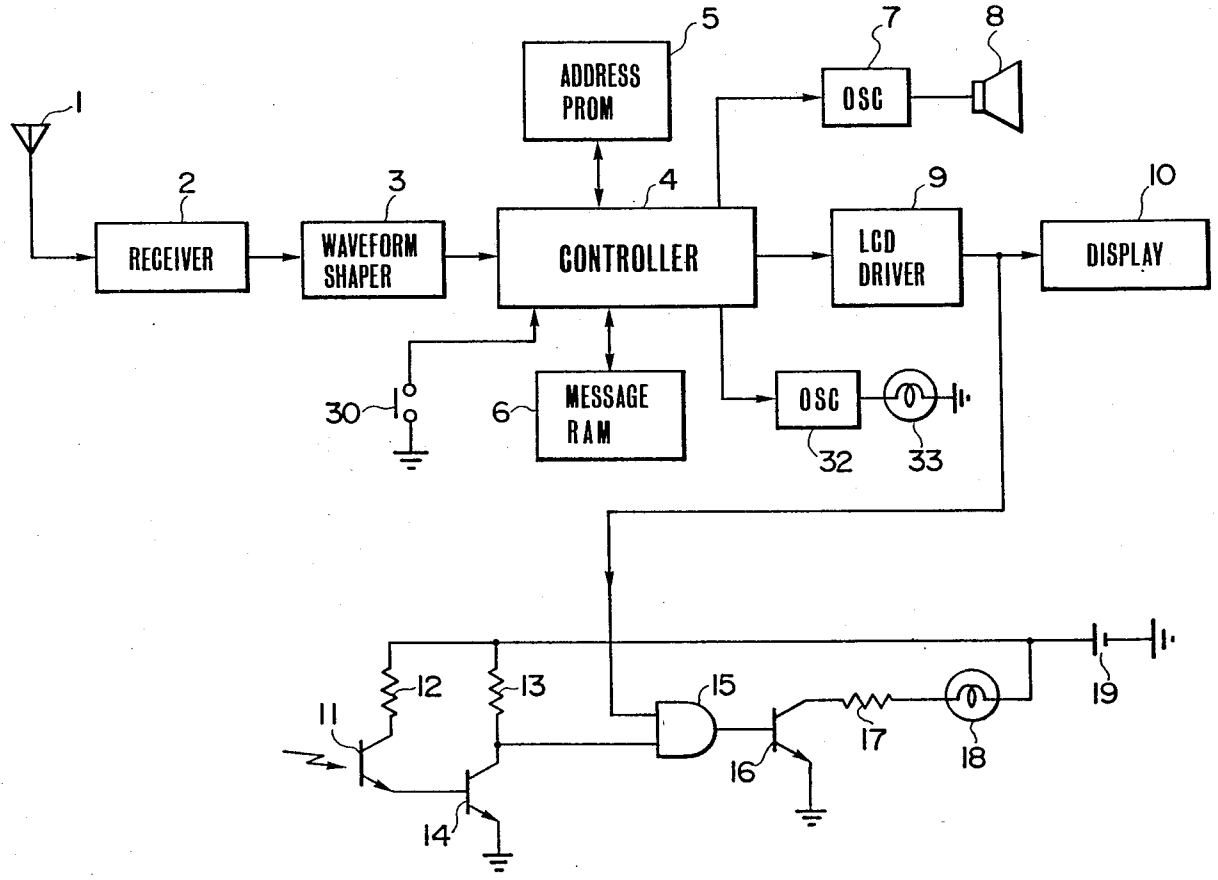
FIG. 1 is a block diagram of a pager according to an embodiment of the present invention.

FIG. 1 is a block diagram of a pager embodying the present invention. In FIG. 1, an antenna 1 receives a signal that is coupled to a receiver 2 that supplies a demodulated output to a waveform shaper 3. The output of waveshaper 3 is coupled to a controller 4. The function of the controller not only controls switching on and off of receiver 2 and waveform shaper 3, it may also operate these circuits on an intermittent basis to extend the life of batteries in the pager. The controller includes a decoder and a central processing unit, the decoder being associated with an address PROM (programmable read-only memory) 5 and the CPU being associated with a message RAM (random access memory) 6. Decoder compares received address words with an address word stored in memory 5 to see if the particular pager has been called. If controller 4 detects a call to this pager, an alert oscillator 7 feeds a speaker 8 to alert the user. A message word following the address word is placed into memory 6 for later retrieval upon operation of a button 30. The message word is also fed to an LCD driver 9 and thence to a liquid-crystal display 10.

The pager of the present invention further includes a phototransistor 11 having a collector coupled through a current limiting resistor 12 to a battery 19 and an emitter connected to the base of a transistor 14. Transistor 14 is biased into conduction in response to an emitter current being supplied from phototransistor 11 when it receives light rays from external source. Transistor 14 draws current through resistor 13 when the lighting condition has a luminance which is sufficient to illuminate the display 10. No current is thus generated in transistor 14 when display 10 is poorly lit and under this condition the potential at the collector of transistor 14 is raised to a logical 1 which enables an AND gate 15. A second input to AND gate 15 is supplied from the output of LCD driver 9 which is at a logical 1 when message is being displayed. The output of AND gate is at logical 1 when message is displayed while luminance is low and turns on a transistor 16, drawing a current through lamp 18 and resistor 17. Lamp 18 illuminates display 10 to compensate for the insufficient luminance.

Flashing indication is also given when flash oscillator 32 is activated in response to receipt of a call under the control of controller 4 and flashes lamp 33.

Figure 2:
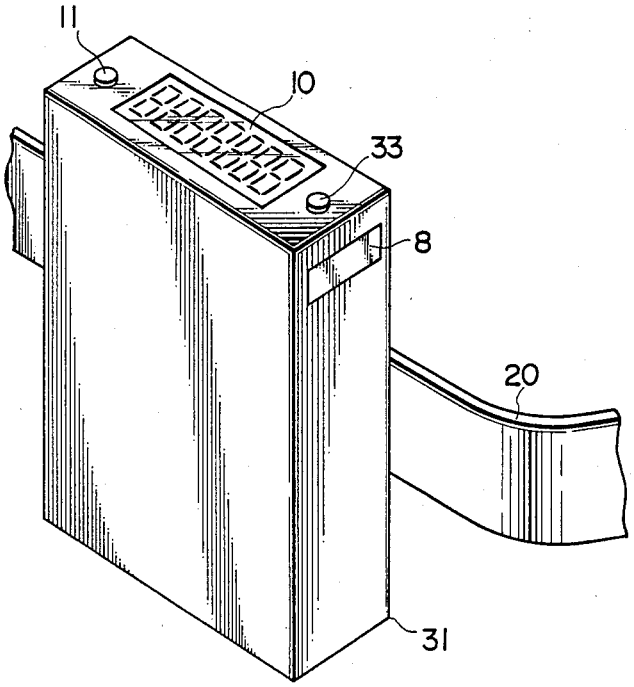
FIG. 2 is a perspective view of the pager.

It would be useful to the user to read the displayed message while carrying a pager on his waist. In FIG. 2, display 10 is mounted on the top of a casing 31 which is formed of an opaque material such as ABS resin or polycarbonate and which is strapped to the waist of the user using a belt 20 and held in a position that makes display 10 visible from above. Phototransistor 11 is located in a position adjacent one end of display 10 and flash lamp 33 in a position adjacent the other end of display 10. This is to keep the flash lamp from interferring with phototransistor 11. The light receiving surface of phototransistor 11 is covered by a glass member which is sealed to the edge of a hole in the casing to make it waterproof. Since the phototransistor is compact, it occupies a very small area on the top of casing 31. It would be advantageous to allow the user to increase the contrast of the message which is displayed under a relatively high lighting condition. This is simply done by covering the window of phototransistor 11 with a finger.

Figure 3:
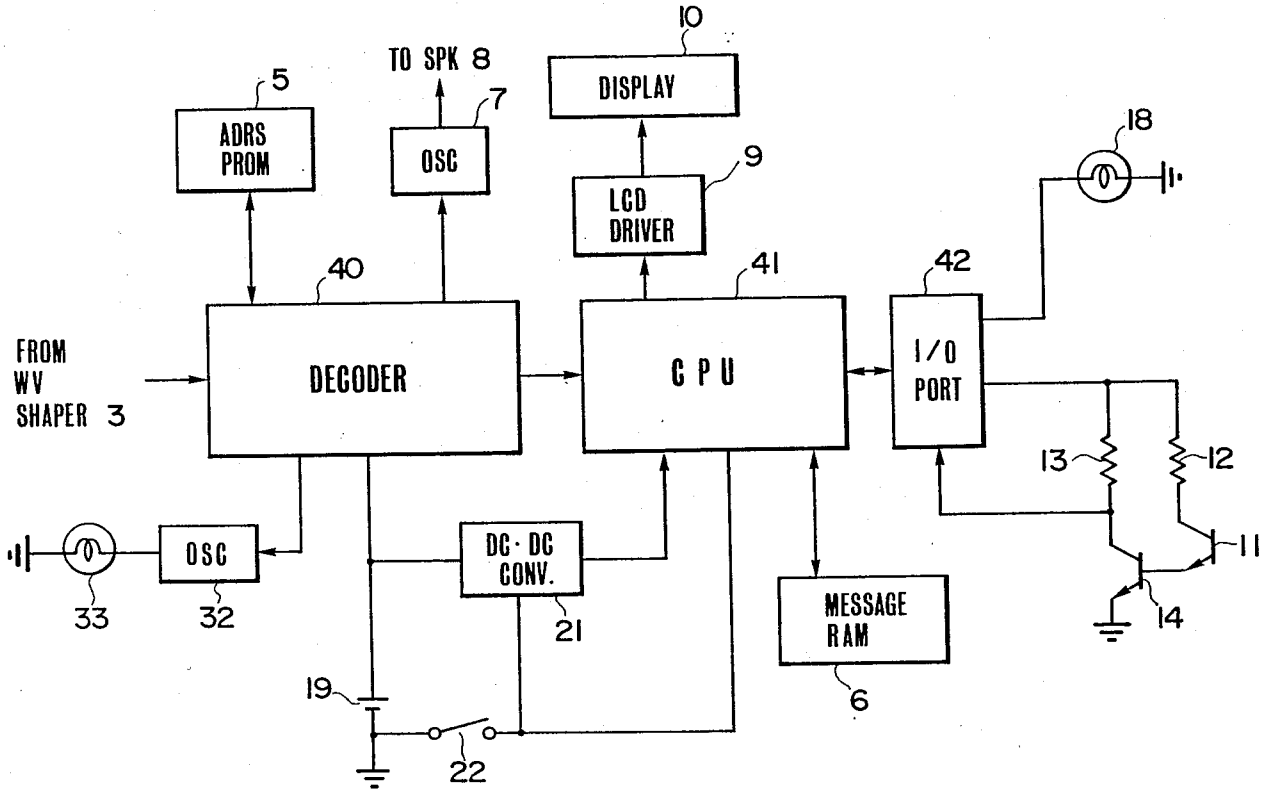
FIG. 3 is a block diagram of a pager according to another embodiment of the invention

In the above embodiment phototransistor 11 is constantly powered once the pager is turned on. For power saving purposes, it is advantageous to shut off power supply to phototransistor 11 when there is no message being displayed. The circuit of FIG. 3 provides a power shut-off feature. In FIG. 3, controller 4 comprises decoder 40, central processing unit 41 and input/output port 42. A DC—DC converter 21 provides boost to the DC potential applied from batteries 19 to decoder 40 to a level appropriate for operating the CPU 41. Lamp 18 is coupled to an output port and the collector of phototransistor 11 is coupled through resistor 12 to an output port and the collector of transistor 14 is connected to an input port.

Figure 4:
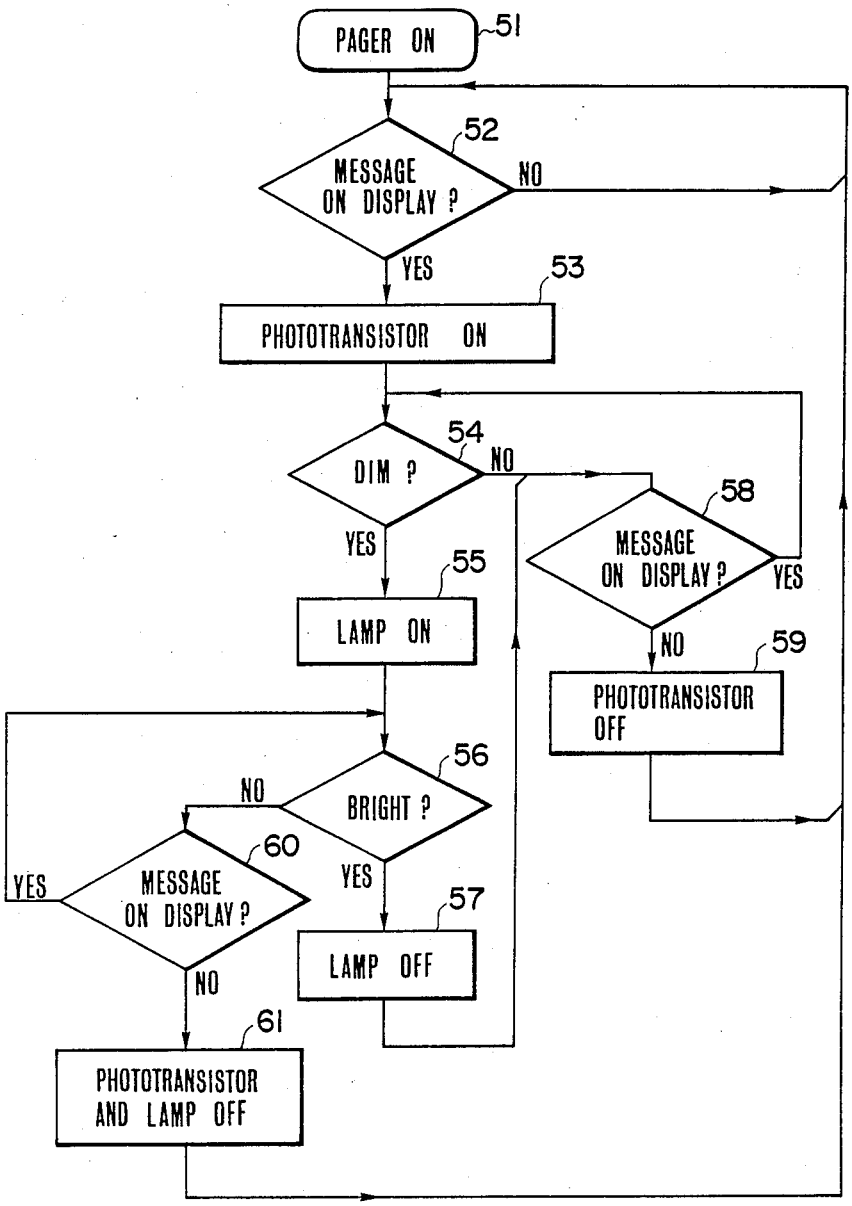
FIG. 4 is a flowchart describing the method of operation of the pager of the invention.

FIG. 4 is a block diagram of the method of operation of the display pager of FIG. 3. In FIG. 4, block 51 turns on the pager in response to the pressing on a power-on switch 22. Decision block 52 next tests for the presence of a message being displayed on display 10. If there is a message on display, execution block 53 applies a potential to phototransistor 11. Next follows a decision block 54 which checks the potential at the collector of transistor 14 to see if it is lower than a predetermined value. If display 10 is dimly lit under poor lighting condition, exit from decision block 54 is to block 55 that turns on lamp 18, illuminating display 10 and if it is brightly shone, exit from block 54 is to decision block 58. Block 58 tests the presence of the message on display 10 and detects when the message ceases to exist. If the message is still on display, exit from block 58 is to block 54 to loop around blocks 54 and 58 until the message disappears, whereupon block 59 is executed by removing the potential from phototransistor 11. With lamp 18 being turned on, control proceeds to decision block 56 which tests the potential at the base of transistor 14 to see if the ambient condition is still dim or has changed to a level sufficient to illuminate display 10. If ambient condition has changed to the high luminance, exit from block 56 is to execution block 57 that turns off lamp 18 and thence to decision block 58 to keep the message on display under external light as control loops around blocks 54 and 58.

Exit from decision block 56 is to decision block 60 if the poor lighting condition still prevails while message is being is displayed. Block 60 tests for the presence of the message still on display. If present, control exits to block 56 and loops around blocks 60 and 56 until the message disappears, whereupon exit from block 60 is to execution block 61 that turns off phototransistor 11 and lamp 18 simultaneously.

Thus, power supply to phototransistor 11 is shut off during periods when no message is displayed, thus minimizing power consumption.

The foregoing description shows only preferred embodiments of the present invention. Various modifications are apparent to those skilled in the art without departing from the scope of the present invention which is only limited by the appended claims. Therefore, the embodiments shown and described are only illustrative, not restrictive.

What is claimed is:

1. A pager comprising:

a receiver for receiving a paging signal bearing an address of said pager and a message;

means for detecting said address in the received signal;

means for displaying said message in response to the detection of said address;

a light sensor for generating a second signal indicating that ambient light has a luminance lower than a predetermined value;

means for detecting a coincidence between the presence of said message on said display means and the generation of said second signal; and a light source for illuminating said display means in response to the detection of said coincidence.

2. A pager as claimed in claim 1, further comprising indicator means for giving a flashing indication in response to the detection of said address and a casing having a top surface, and means for fastening said casing to a user so that said top is visible from above, wherein said display means is located on the top of said casing, said light sensor is located on said top adjacent to one end of said display means and said indicator means is located on said top adjacent to the other end of said display means.

3. A pager as claimed in claim 1, further comprising a casing having an opening therein, wherein said light sensor comprises a phototransistor located behind a transparent member which is fluid-tightly engaged in said opening to receive light through said transparent member.

4. A pager as claimed in claim 1, wherein said light sensor comprises:

a phototransistor having first and second controlled electrodes;

a second transistor having a control electrode connected through the first and second controlled electrodes of said phototransistor to a voltage source, the second transistor having a first controlled electrode connected to one terminal of said voltage source and a second controlled electrode connected through a resistor to the other terminal of said voltage source, a junction between said resistor and said second electrode being connected to said coincidence detecting means.

5. A pager as claimed in claim 1, further comprising means for shutting off power supply to said light sensor in the absence of said message on said display means.

6. A pager as claimed in claim 5, wherein said light sensor comprises:

a phototransistor having a first controlled electrode connected to a first port and a second controlled electrode;

a second transistor having a control electrode connected to the second electrode of said phototransistor, the second transistor having a first controlled electrode connected to a common ground and a second controlled electrode connected through a resistor to said first port, a junction between said resistor and said second electrode being connected to a second port, further comprising means for coupling a voltage to said first port in response to the signal indicating the presence of said message on said display means and decoupling said voltage from said first port in response to the absence of the last-mentioned signal, said coincidence detecting means being responsive to a voltage level at said second port as said signal indicating the presence of said ambient light having said lower luminance value.

7. A pager as claimed in claim 1, wherein said display means is a liquid crystal display.

* * * * *